US010117016B2

(12) United States Patent
Wang et al.

(10) Patent No.: US 10,117,016 B2
(45) Date of Patent: Oct. 30, 2018

(54) EARPHONE CAPABLE OF REDUCING PRESSURE IN EAR CANAL AND PROVIDING ENHANCED SOUND QUALITY AND METHOD FOR MAKING THE SAME

(71) Applicants: Shih-Chun Wang, Tainan (TW); Tai-Chen Kuo, Tainan (TW)

(72) Inventors: Shih-Chun Wang, Tainan (TW); Tai-Chen Kuo, Tainan (TW)

( * ) Notice: Subject to any disclaimer, the term of this patent is extended or adjusted under 35 U.S.C. 154(b) by 0 days.

(21) Appl. No.: 15/384,863

(22) Filed: Dec. 20, 2016

(65) Prior Publication Data

US 2018/0146279 A1 May 24, 2018

(30) Foreign Application Priority Data

Nov. 24, 2016 (TW) ..... 105138614 A

(51) Int. Cl.
*H04R 1/10* (2006.01)

(52) U.S. Cl.
CPC ..... *H04R 1/1091* (2013.01); *H04R 1/1075* (2013.01); *H04R 2460/11* (2013.01)

(58) Field of Classification Search
CPC .. H04R 1/1091; H04R 1/1008; H04R 1/1016; H04R 1/1058; H04R 2460/11
USPC ..... 381/373, 386, 380
See application file for complete search history.

(56) References Cited

U.S. PATENT DOCUMENTS 6,668,064 B1 * 12/2003 Lin ..... H04R 1/1016 381/328
2016/0192065 A1 * 6/2016 Oosato ..... H04R 1/2826 381/378

* cited by examiner

*Primary Examiner* — Sunita Joshi
(74) *Attorney, Agent, or Firm* — Rosenberg, Klein & Lee

(57) ABSTRACT

An earphone capable of reducing pressure in the ear canal and providing enhanced sound quality is provided along with a method for making the same. The earphone includes an earphone body penetrated by an air channel and having a receiving space receiving a vibrating membrane. A loudspeaker is provided in the receiving space and corresponds to the vibrating membrane. When the earphone is worn in the ear, the ear canal is in communication with the outside through the air channel so that acoustic waves generated by the vibrating membrane and reflected by the eardrum can propagate out of, rather than back and forth within, the ear canal. Thus, the eardrum is safe from an abnormal pressure otherwise attributable to repeatedly reflected acoustic waves, and the vibrating membrane is protected from a compressive force that may otherwise result from reflected acoustic waves and cause sound distortion.

8 Claims, 9 Drawing Sheets

EARPHONE CAPABLE OF REDUCING PRESSURE IN EAR CANAL AND PROVIDING ENHANCED SOUND QUALITY AND METHOD FOR MAKING THE SAME

BACKGROUND OF THE INVENTION

1. Technical Field

The present invention relates to an earphone that can reduce pressure in the ear canal and provide enhanced sound quality. More particularly, the invention relates to an earphone with an air channel passing through the earphone body so that acoustic waves reflected by the eardrum while the earphone is in use can propagate out of the ear canal through the air channel to reduce pressure in the ear canal and thereby contribute to an enhancement in sound quality.

2. Description of Related Art

The conventional earphones, as disclosed in Taiwan Utility Model Patent No. M517497, entitled "Speaker Unit and Earphone", and Taiwan Utility Model Patent No. M529998, entitled "Earphone with Moving-Coil Piezoelectric Dual-Frequency Speaker", typically include a loudspeaker provided in a closed receiving space, wherein the loudspeaker can vibrate a vibrating membrane in order for the resulting acoustic waves to propagate to the eardrum to make sound.

The prior art earphones, however, have the following drawbacks during use:

1. When an earphone is worn in/on/around the ear, the ear canal is blocked by the earphone and turned into a closed space, in which acoustic waves generated by the vibrating membrane travel back and forth between the earphone and the eardrum, causing abnormal pressure on the eardrum and consequently a sense of discomfort.

2. The acoustic waves propagating to and fro in the ear canal also generate a compressive force on the vibrating membrane such that acoustic waves subsequently generated by the vibrating membrane are compromised, resulting in distortion of sound, especially in the medium- to high-frequency range.

BRIEF SUMMARY OF THE INVENTION

The present invention provides an earphone capable of reducing pressure in the ear canal and furnishing enhanced sound quality, wherein the earphone includes an earphone body and a loudspeaker as described below.

The earphone body is penetrated by an air channel and defines a receiving space therein. The receiving space is provided therein with a vibrating membrane. The loudspeaker is also provided in the receiving space and corresponds to the vibrating membrane.

Preferably, the earphone body has a front end and a rear end facing away from the front end, and the air channel is open at both the front end and the rear end of the earphone body.

Preferably, the earphone body has a central portion and a peripheral portion, and the air channel extends through the central portion.

Preferably, the earphone body has a central portion and a peripheral portion, and the air channel extends through the peripheral portion and flares or is reduced at the rear end of the earphone body.

Preferably, the earphone body is circumaural, supra-aural, or ear-fitting.

The present invention also provides a method for making an earphone capable of reducing pressure in the ear canal and providing enhanced sound quality, wherein the method includes the steps of:

A. providing an earphone body penetrated by an air channel; and B. providing a loudspeaker in a receiving space in the earphone body, wherein the loudspeaker corresponds to a vibrating membrane in the earphone body.

Preferably, in the step A, the air channel is open at a front end and a rear end of the earphone body and extends through a central portion of the earphone body.

Preferably, in the step A, the air channel is open at a front end and a rear end of the earphone body and extends through a peripheral portion of the earphone body.

Preferably, the air channel flares or is reduced at the rear end of the earphone body.

The foregoing technical features can produce the following effects:

1. When the earphone body is worn in/on/around the ear, the ear canal can communicate with the outside through the air channel. When acoustic waves generated by the vibrating membrane are reflected by the eardrum, the reflected acoustic waves will not travel back and forth in the ear canal but will propagate out of the ear canal via the air channel, thereby reducing any abnormal pressure that may act on the eardrum due to the otherwise repeatedly reflected acoustic waves. The earphone is therefore more comfortable to use than the prior art.

2. As acoustic waves reflected by the eardrum will leave the ear canal through the air channel, they do not apply a compressive force on the vibrating membrane, and distortion of sound is thus prevented. The present invention allows the user's eardrum to feel the original state of sound rather than an artificial acoustic field, which is typical of common earphones.

DETAILED DESCRIPTION OF THE INVENTION

The present invention incorporates the aforesaid technical features into an earphone capable of reducing pressure in the ear canal and providing enhanced sound quality and a method for making the same. The major effects of the present invention are detailed below with reference to some illustrative embodiments.

Figure 1:
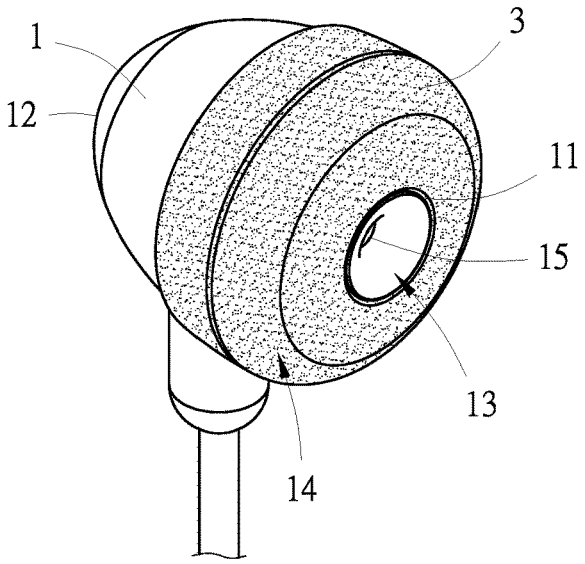
FIG. 1 is a perspective view of the first embodiment of the present invention.
Figure 2:
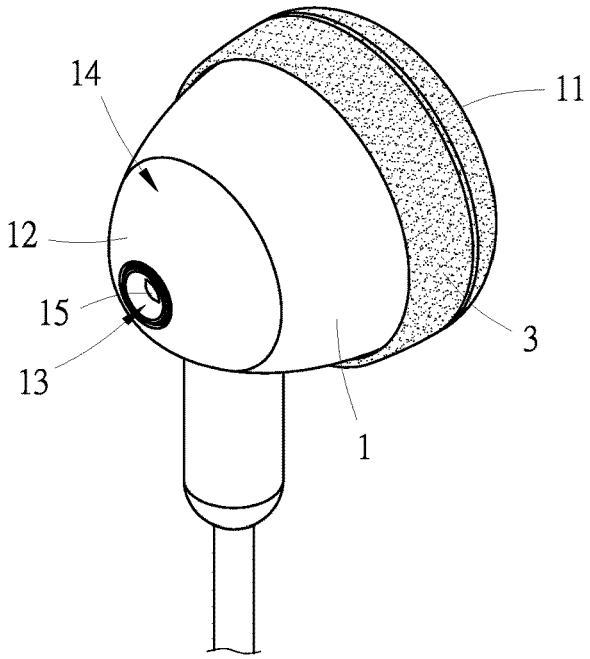
FIG. 2 is a perspective view of the first embodiment taken from a different viewpoint from that of FIG. 1.
Figure 3:
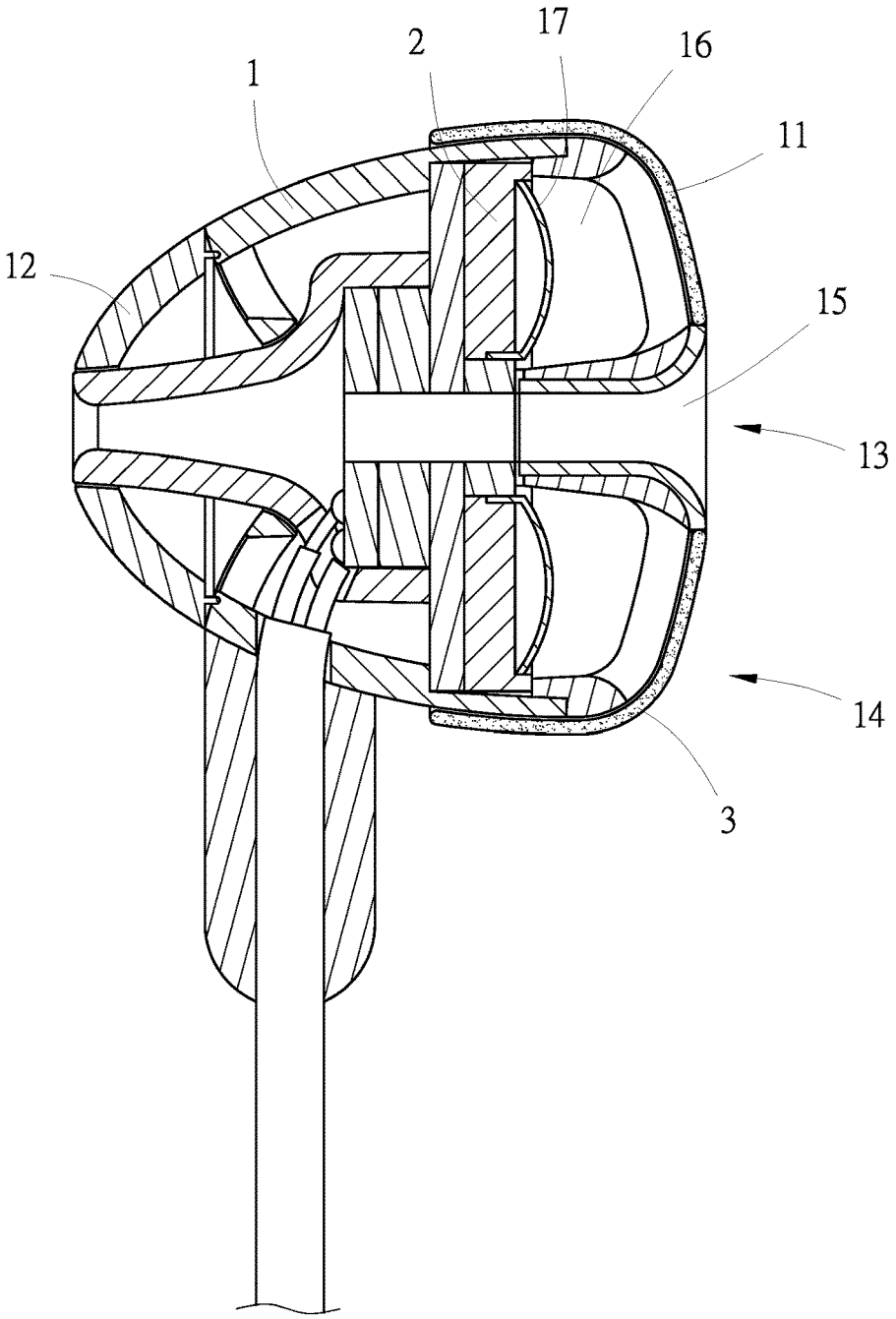
FIG. 3 is a sectional view of the first embodiment.

Referring to FIG. 1, FIG. 2, and FIG. 3, the earphone in the first embodiment of the present invention is structured as follows and made by a method that includes:

Step A: An earphone body 1 is provided and has its front end 11 and rear end 12 defined. Also defined are a central portion 13 and a peripheral portion 14 of the earphone body 1. Step B: The earphone body 1 is penetrated by an air channel 15 that opens at both the front end 11 and the rear end 12. The air channel 15 in this embodiment extends through the central portion 13. Step C: A loudspeaker 2 is provided in a receiving space 16 in the earphone body 1 and corresponds to a vibrating membrane 17 in the earphone body 1. In addition, a sponge cover 3 is mounted over the front end 11 of the earphone body 1.

Figure 4:
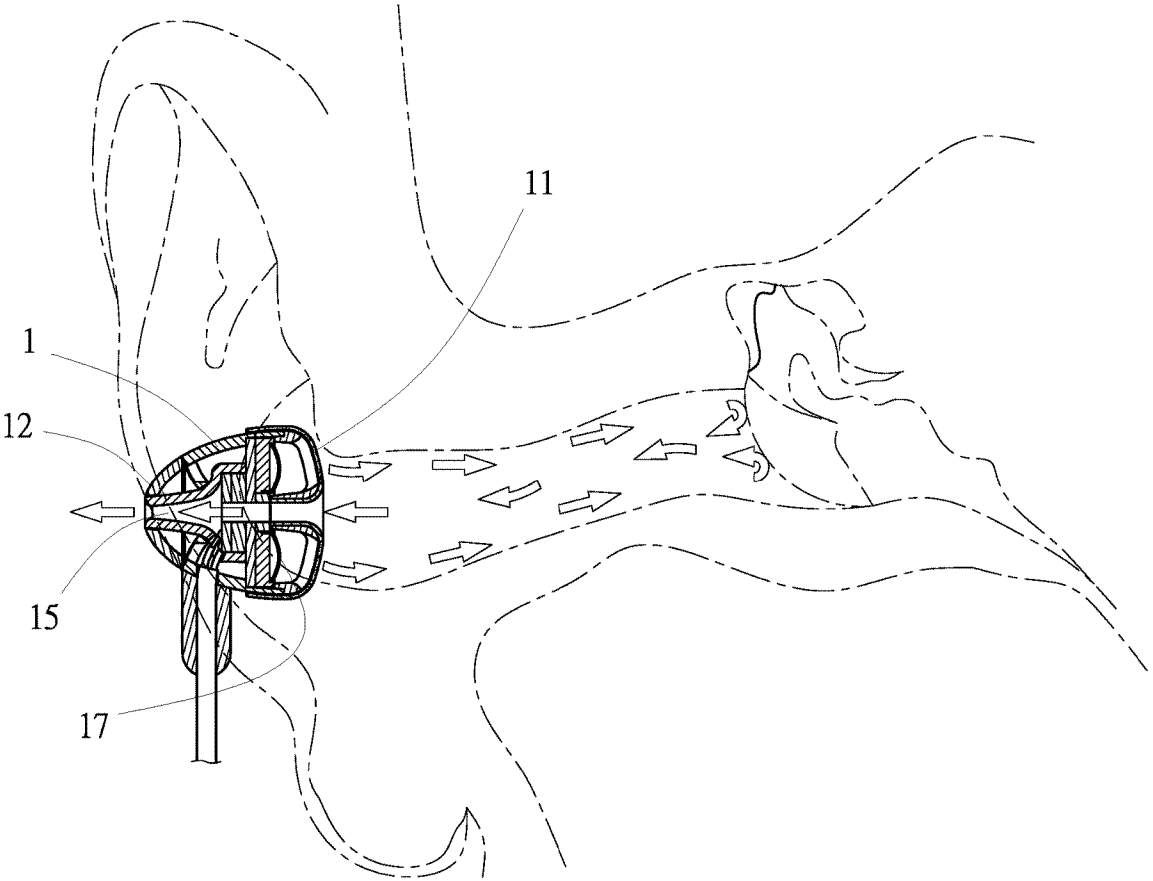
FIG. 4 shows a state of use of the first embodiment.

Referring to FIG. 4, when the earphone body 1 is worn in an ear, the air channel 15, which is open at both the front end 11 and the rear end 12 of the earphone body 1, allows the ear canal to communicate with the outside. While the earphone is playing sound, the loudspeaker 2 causes the vibrating membrane 17 to vibrate and generate acoustic waves. Once the acoustic waves are reflected by the eardrum, the reflected acoustic waves propagate out of the ear canal through the air channel 15 and therefore will not travel back and forth in the ear canal, let alone applying an abnormal pressure on the eardrum. As the reflected acoustic waves propagate out of the ear canal through the air channel 15, the same acoustic waves are also kept from applying a compressive force on the vibrating membrane 17 and hence from creating distortion of sound.

Figure 5:
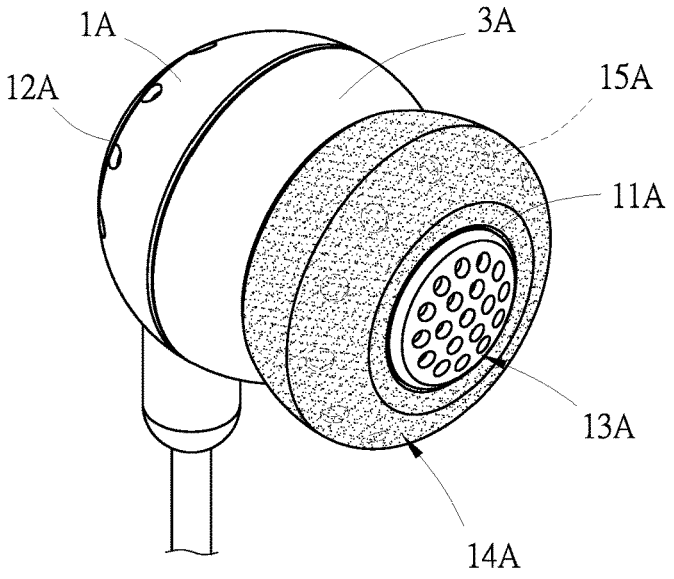
FIG. 5 is a perspective view of the second embodiment of the present invention.
Figure 6:
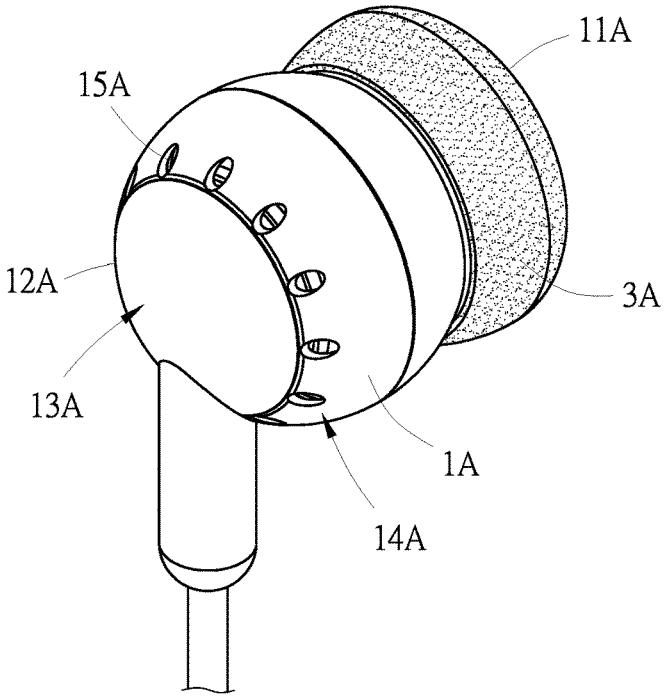
FIG. 6 is a perspective view of the second embodiment taken from a different viewpoint from that of FIG. 5.
Figure 7:
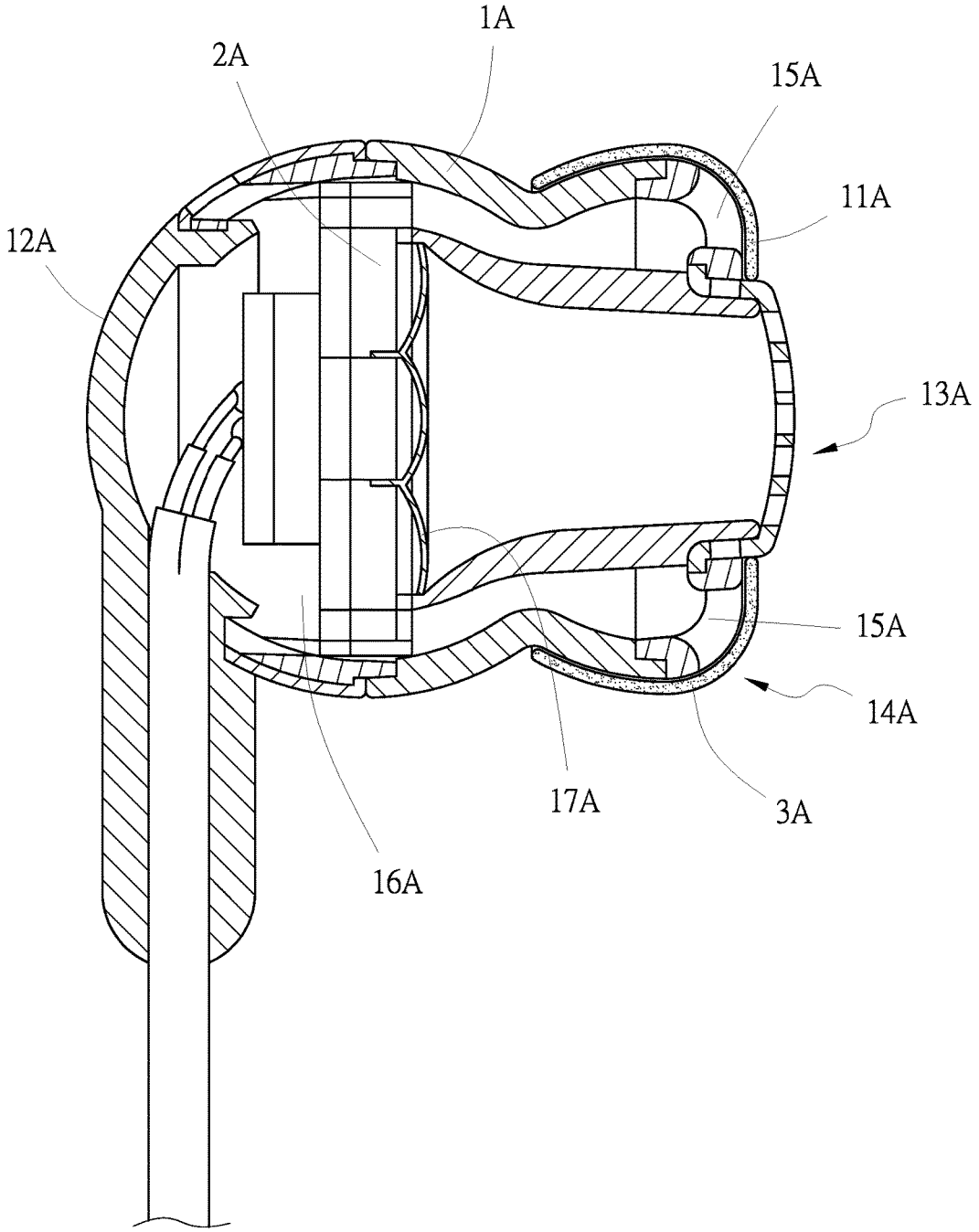
FIG. 7 is a sectional view of the second embodiment.

In the second embodiment of the present invention as shown in FIG. 5, FIG. 6, and FIG. 7, the earphone is structured and made in the way as in the first embodiment except that:

The earphone includes an earphone body 1A with two opposite ends, namely a front end 11A and a rear end 12A. The earphone body 1A further has a central portion 13A and a peripheral portion 14A. An air channel 15A penetrates the earphone body 1A and is open at both the front end 11A and the rear end 12A. In this embodiment, the air channel 15A extends through the peripheral portion 14A and flares at the rear end 12A. The earphone body 1A defines a receiving space 16A therein, and a vibrating membrane 17A is provided in the receiving space 16A. A loudspeaker 2A is also provided in the receiving space 16A and corresponds to the vibrating membrane 17A. A sponge cover 3A is mounted over the front end 11A of the earphone body 1A.

Figure 8:
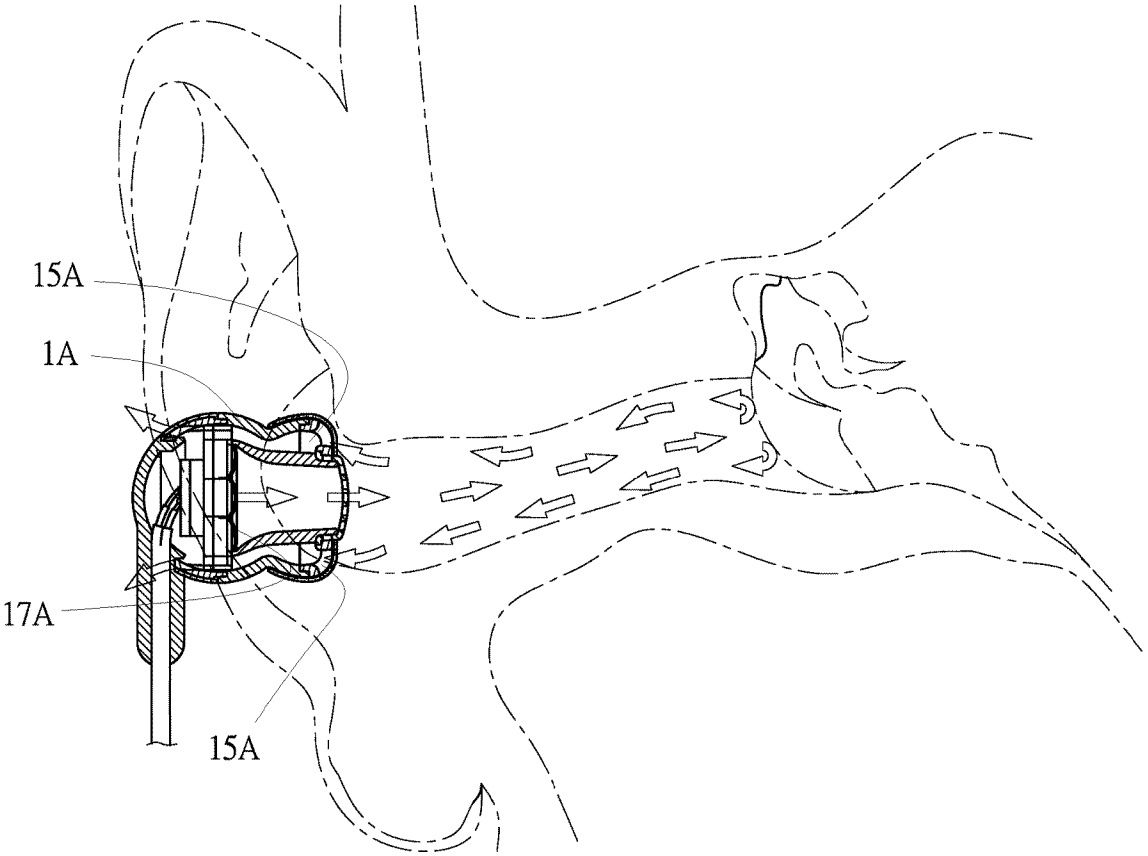
FIG. 8 shows a state of use of the second embodiment.

As in the first embodiment, referring to FIG. 8, the air channel 15A of the earphone body 1A allows acoustic waves reflected by the eardrum to propagate out of the ear canal, rather than to and fro inside the ear canal. Thus, not only is the eardrum safe from an abnormal pressure otherwise attributable to repeatedly reflected acoustic waves, but also the vibrating membrane 17A is protected from a compressive force that may otherwise result from the reflected acoustic waves and cause sound distortion.

Figure 9:
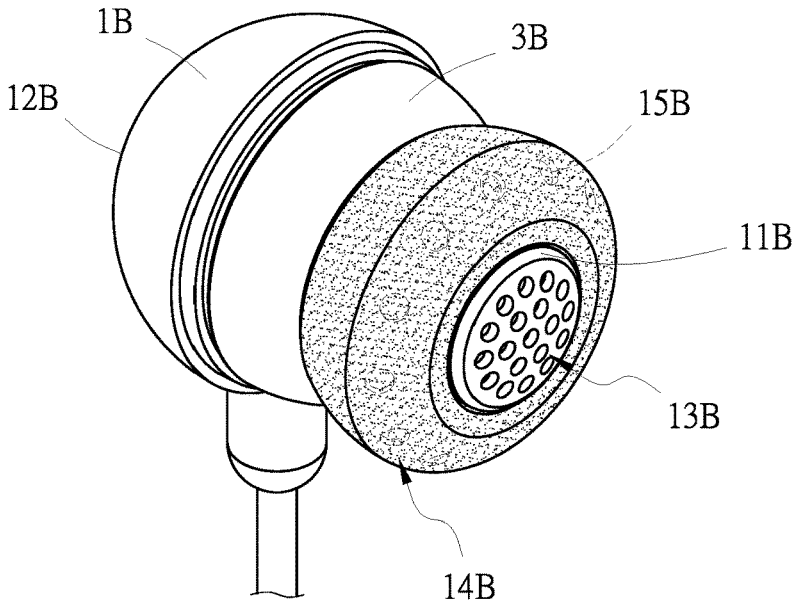
FIG. 9 is a perspective view of the third embodiment of the present invention.
Figure 10:
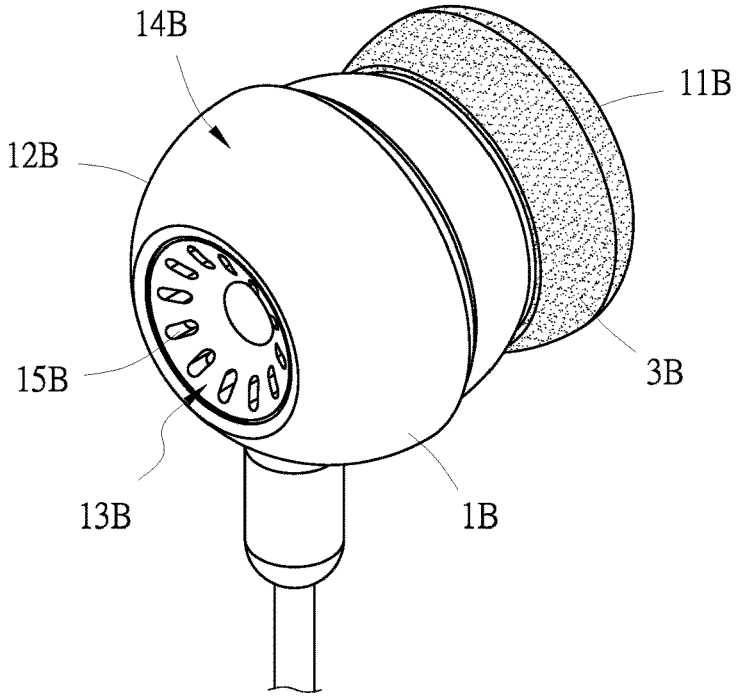
FIG. 10 is a perspective view of the third embodiment taken from a different viewpoint from that of FIG. 9.
Figure 11:
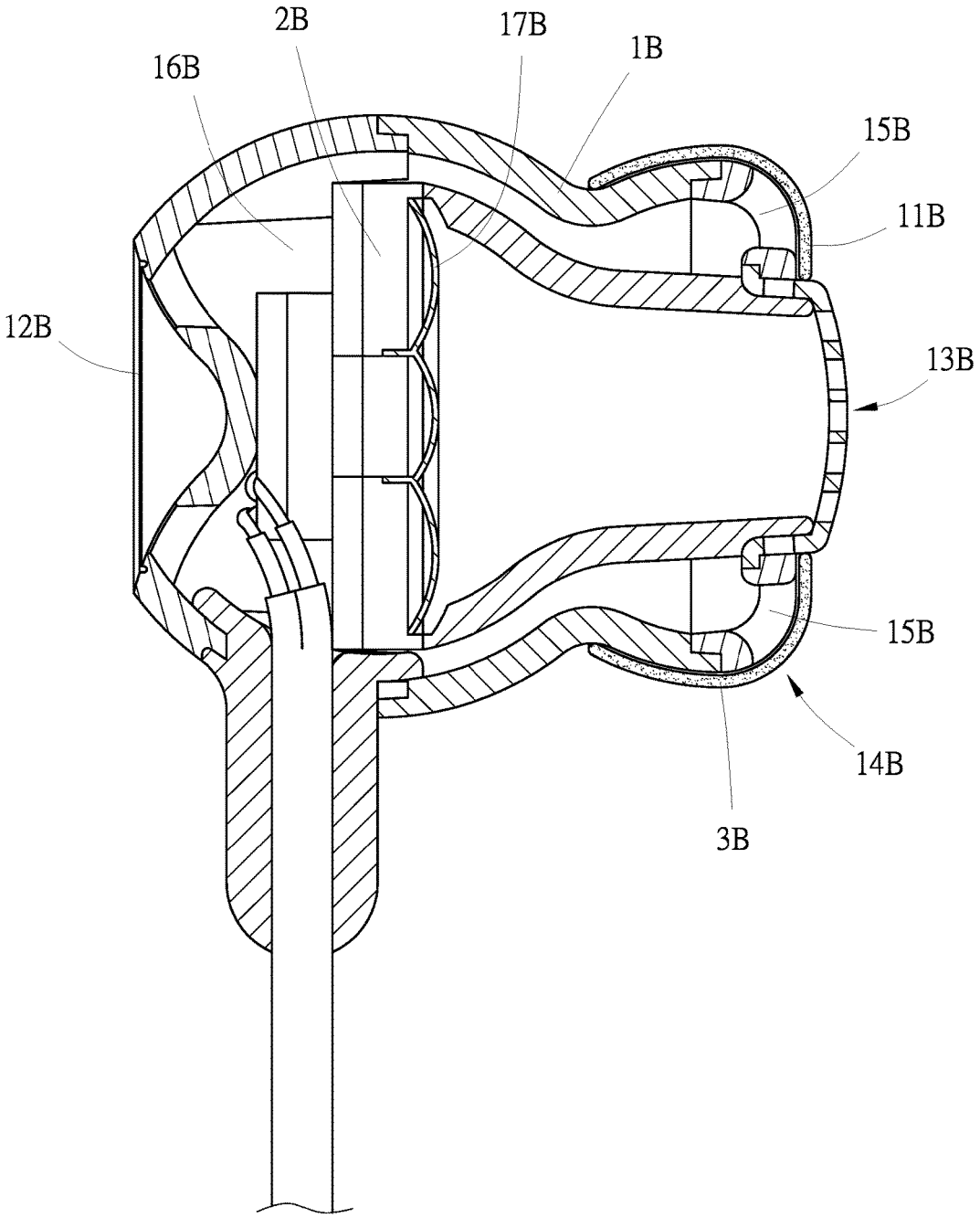
FIG. 11 is a sectional view of the third embodiment.

FIG. 9, FIG. 10, and FIG. 11 show the third embodiment of the present invention, in which the earphone is structured and made in the way as in the first embodiment except that:

The earphone includes an earphone body 1B with two opposite ends, namely a front end 11B and a rear end 12B. The earphone body 1B further has a central portion 13B and a peripheral portion 14B. An air channel 15B penetrates the earphone body 1B and is open at both the front end 11B and the rear end 12B. In this embodiment, the air channel 15B extends through the peripheral portion 14B and is reduced at the rear end 12B. The earphone body 1B defines a receiving space 16B therein, and a vibrating membrane 17B is provided in the receiving space 16B. A loudspeaker 2B is also provided in the receiving space 16B and corresponds to the vibrating membrane 17B. A sponge cover 3B is mounted over the front end 11B of the earphone body 1B.

Figure 12:
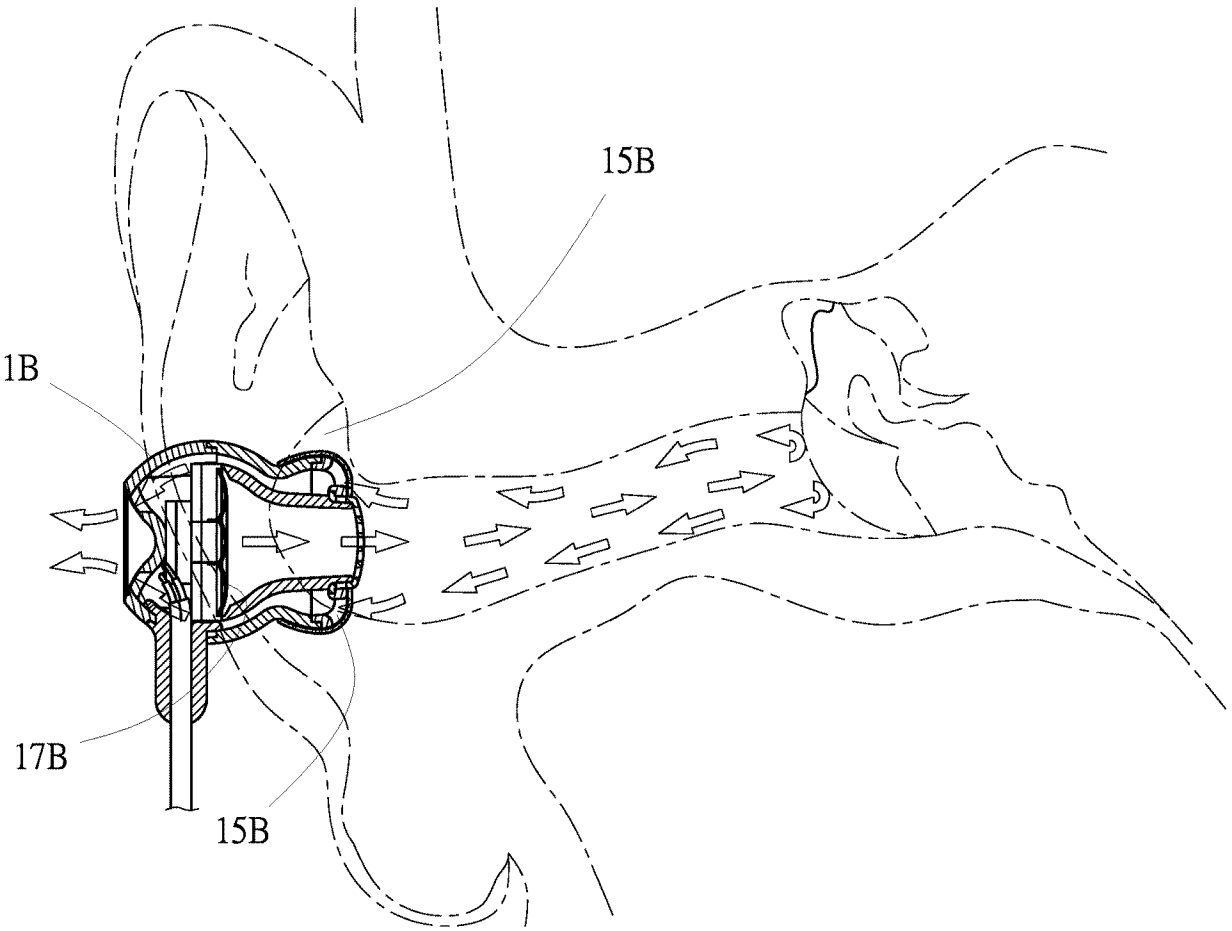
FIG. 12 shows a state of use of the third embodiment.

As in the first embodiment, referring to FIG. 12, the air channel 15B of the earphone body 1B allows acoustic waves reflected by the eardrum to propagate out of the ear canal, rather than to and fro inside the ear canal. Thus, not only is the eardrum safe from an abnormal pressure otherwise attributable to repeatedly reflected acoustic waves, but also the vibrating membrane 17B is protected from a compressive force which may otherwise result from the reflected acoustic waves and cause sound distortion.

The embodiments described above are intended to demonstrate that, regardless of the forms of the air channels 15, 15A, and 15B, the present invention is characterized by the air channels 15, 15A, and 15B penetrating the earphone bodies 1, 1A, and 1B and opening at the corresponding front ends 11, 11A, and 11B and rear ends 12, 12A, and 12B respectively such that, once the earphone body 1, 1A, or 1B is worn in the ear, the ear canal is still in communication with the outside through the air channel 15, 15A, or 15B. The air channel in the present invention is preferably open at the front and rear ends of the earphone body but may also be located and shaped differently, depending on the configuration of the earphone body. For example, the air channel may be formed in a lateral portion of each earphone body of a pair of circumaural or supra-aural headphones. Accordingly, all earphones provided with the air channel disclosed herein are encompassed by the present invention, whether they are circumaural, supra-aural, ear-fitting, or of any other types (i.e., be they in-ear monitors (also known as canal-phones), clip-on earphones, neckband earphones, wireless Bluetooth earphones, over-ear headphones, noise-cancelling earphones, on-ear headphones, open-back earphones, closed-back earphones, or others).

The above description of the embodiments should be able to enable a full understanding of the operation, use, and intended effects of the present invention. It should be understood, however, that the embodiments provided herein are only some preferred ones of the invention and are not intended to be restrictive of the scope of the invention. All simple equivalent changes and modifications made according to the disclosure of this specification and the appended claims should fall within the scope of the present invention.

What is claimed is:

1. An earphone capable of reducing pressure in an ear canal and providing enhanced sound quality, comprising:

an earphone body having opposing front and rear ends and a receiving space formed therein, the earphone body having an air channel formed therein with openings at each of the front and rear ends of the earphone body and providing open fluid communication therebetween, the air channel being fluidly separated from the receiving space;

a vibrating membrane disposed in the receiving space; and a loudspeaker disposed in the receiving space in correspondence with the vibrating membrane to generate acoustic waves, and wherein reflected acoustic waves are conveyed through the air channel to exit therefrom through the openings in the rear end of the earphone body.

2. The earphone of claim 1, wherein the earphone body has a central portion and a peripheral portion, and the air channel extends through the central portion.

3. The earphone of claim 1, wherein the earphone body has a central portion and a peripheral portion, and the air channel extends through the peripheral portion.

4. The earphone of claim 3, wherein the air channel flares or is reduced at the rear end of the earphone body.

5. The earphone of claim 1, wherein the earphone body is circumaural, supra-aural, or ear-fitting.

6. A method for making an earphone capable of reducing pressure in an ear canal and providing enhanced sound quality, comprising:

A. providing an earphone body with a receiving space from which acoustic waves are generated and propagated therefrom;

B. providing a loudspeaker and a vibrating membrane in the receiving space of the earphone body, the loudspeaker being disposed in correspondence with the vibrating membrane to generate the acoustic waves; and C. providing a fluidly separate and distinct air channel within the earphone body, the air channel conveying reflected acoustic waves therethrough, and providing openings at a front end and a rear end of the earphone body, the air channel being formed to extend between the openings through a central portion of the earphone body.

7. A method for making an earphone capable of reducing pressure in an ear canal and providing enhanced sound quality, comprising:

A. providing an earphone body with a receiving space from which acoustic waves are generated and propagated therefrom;

B. providing a loudspeaker and a vibrating membrane in the receiving space of the earphone body, the loudspeaker being disposed in correspondence with the vibrating membrane to generate the acoustic waves; and C. providing a fluidly separate and distinct air channel within the earphone body, the air channel conveying reflected acoustic waves therethrough, and providing openings at a front end and a rear end of the earphone body, the air channel being formed to extend between the openings through a peripheral portion of the earphone body.

8. The method of claim 7, wherein the step of providing a fluidly separate and distinct air channel includes providing an air channel the flares or is reduced at the rear end of the earphone body.

* * * * *